US009972471B2

(12) United States Patent
Letexier et al.

(10) Patent No.: US 9,972,471 B2
(45) Date of Patent: May 15, 2018

(54) BIMODE IMAGE ACQUISITION DEVICE WITH PHOTOCATHODE

(71) Applicant: Photonis France, Brive (FR)

(72) Inventors: Damien Letexier, Brive (FR); Franck Robert, Brive (FR)

(73) Assignee: PHOTONIS FRANCE, Brive (FR)

( * ) Notice: Subject to any disclaimer, the term of this patent is extended or adjusted under 35 U.S.C. 154(b) by 0 days. days.

(21) Appl. No.: 15/512,253

(22) PCT Filed: Sep. 22, 2015

(86) PCT No.: PCT/EP2015/071789
§ 371 (c)(1),
(2) Date: Mar. 17, 2017

(87) PCT Pub. No.: WO2016/046235
PCT Pub. Date: Mar. 31, 2016

(65) Prior Publication Data

US 2017/0287667 A1 Oct. 5, 2017

(30) Foreign Application Priority Data

Sep. 22, 2014 (FR) ..... 14 58903

(51) Int. Cl.
*H01J 31/49* (2006.01)
*H01J 31/56* (2006.01)
*H01J 31/50* (2006.01)

(52) U.S. Cl.
CPC ..... *H01J 31/56* (2013.01); *H01J 31/508* (2013.01); *H01J 2231/50026* (2013.01)

(58) Field of Classification Search
CPC ..... H04N 2209/045; G01J 2003/516; H01J 2231/50026; H01J 31/508; H01J 31/56
(Continued)

(56) References Cited

U.S. PATENT DOCUMENTS 5,233,183 A * 8/1993 Field ..... H01J 31/56 250/214 VT
5,742,115 A * 4/1998 Gertsenshteyn ..... H01J 31/50 313/365

(Continued)

FOREIGN PATENT DOCUMENTS

| | | |
|---|---|---|
| EA | 95/06388 A1 | 3/1995 |
| GB | 2 302 444 A | 1/1997 |
| JP | H03-112041 A | 5/1991 |

OTHER PUBLICATIONS

Shraddha Tripathi et al., "Image Segmentation: A review", International Journal of Computer Science and Management Research, vol. 1, Issue 4, Nov. 2012.

(Continued)

*Primary Examiner* — Taeho Jo
(74) *Attorney, Agent, or Firm* — Pearne and Gordon LLP

(57) ABSTRACT

Image acquisition device comprising a photocathode, converting an incident flux of photons into a flux of electrons, a sensor, and a processor. The device according to the invention comprises a matrix of elementary filters, each associated with at least one pixel of the sensor, the matrix being disposed upstream of the photocathode. The matrix comprises primary color filters, and transparent filters, termed panchromatic filters. The processor is configured to: calculate a quantity, termed a useful quantity ($\bar{F}$), for determining whether at least one zone of the sensor is in conditions of weak or strong illumination, the useful quantity being representative of a mean surface flux of photons or of electrons which is detected on a set of panchromatic pixels of the sensor; forming, only if the zone is in conditions of strong illumination, an image of the zone on the basis of the primary color pixels of this zone.

16 Claims, 4 Drawing Sheets

| | | | | | | | |
|---|---|---|---|---|---|---|---|
| R | W | G | W | R | W | G | W |
| W | W | W | W | W | W | W | W |
| G | W | B | W | G | W | B | W |
| W | W | W | W | W | W | W | W |
| R | W | G | W | R | W | G | W |
| W | W | W | W | W | W | W | W |
| G | W | B | W | G | W | B | W |
| W | W | W | W | W | W | W | W |

(58) Field of Classification Search
USPC ..... 250/333
See application file for complete search history.

(56) References Cited

U.S. PATENT DOCUMENTS 5,805,342 A * 9/1998 Gravely ..... H04N 5/228 348/E5.031
5,914,749 A * 6/1999 Bawolek ..... H01L 27/14621 257/E27.134
6,456,793 B1 * 9/2002 Ray ..... G01S 17/89 250/214 VT
2003/0147002 A1 * 8/2003 Ray ..... G01S 17/89 348/370
2004/0036013 A1 * 2/2004 Bacarella ..... H01J 31/56 250/214 VT
2007/0040995 A1 * 2/2007 Tangen ..... G09G 3/3413 353/84
2007/0177236 A1 * 8/2007 Kijima ..... H04N 9/045 358/514
2007/0285540 A1 * 12/2007 Kwon ..... H04N 5/332 348/272
2015/0350629 A1 * 12/2015 Keesling ..... H04N 5/2254 348/53
2016/0080706 A1 * 3/2016 Kaiser ..... H04N 5/332 348/280

OTHER PUBLICATIONS

French Search Report issued in Application No. 1458903 dated Jul. 20, 2015.
International Search Report issued in Application No. PCT/EP2015/071789 dated Dec. 15, 2015.
Written Opinion issued in Application No. PCT/EP2015/071789 dated Dec. 15, 2015.

* cited by examiner

| | | | | | | | |
|---|---|---|---|---|---|---|---|
| R | W | G | W | R | W | G | W |
| W | W | W | W | W | W | W | W |
| G | W | B | W | G | W | B | W |
| W | W | W | W | W | W | W | W |
| R | W | G | W | R | W | G | W |
| W | W | W | W | W | W | W | W |
| G | W | B | W | G | W | B | W |
| W | W | W | W | W | W | W | W |

FIG. 3A

| | | | | | | | |
|---|---|---|---|---|---|---|---|
| Ye | W | Ma | W | Ye | W | Ma | W |
| W | W | W | W | W | W | W | W |
| Ma | W | Cy | W | Ma | W | Cy | W |
| W | W | W | W | W | W | W | W |
| Ye | W | Ma | W | Ye | W | Ma | W |
| W | W | W | W | W | W | W | W |
| Ma | W | Cy | W | Ma | W | Cy | W |
| W | W | W | W | W | W | W | W |

FIG. 3B

| | | | | | | | |
|---|---|---|---|---|---|---|---|
| R | W | G | W | R | W | G | W |
| W | W | W | W | W | W | W | W |
| IR | W | B | W | IR | W | B | W |
| W | W | W | W | W | W | W | W |
| R | W | G | W | R | W | G | W |
| W | W | W | W | W | W | W | W |
| IR | W | B | W | IR | W | B | W |
| W | W | W | W | W | W | W | W |

BIMODE IMAGE ACQUISITION DEVICE WITH PHOTOCATHODE

TECHNICAL DOMAIN

This invention relates to the domain of night vision image acquisition devices comprising a photocathode adapted to convert a flux of photons into an flux of electrons. The domain of the invention is more particularly such devices using matrix colour filters.

STATE OF PRIOR ART

Different night vision image acquisition systems comprising a photocathode are known in prior art.

For example one such device is an image intensifier tube comprising a photocathode, adapted to convert an incident flux of photons into an initial flux of electrons. This initial flux of electrons propagates inside the intensifier tube in which it is accelerated by a first electrostatic field towards multiplication means.

These multiplication means receive said initial flux of electrons and in response provide a secondary flux of electrons. Each initial electron, incident on an input face of the multiplication means, provokes the emission of several secondary electrons on the side of the outlet face of these same means. An intense secondary flux of electrons is thus generated from a weak initial flux of electrons, and therefore in fine from a very low intensity light radiation.

The secondary flux of electrons is accelerated by a third electrostatic field towards a phosphor screen that converts the secondary flux of electrons into a flux of photons. Due to the multiplication means, the flux of photons outputted by the phosphor screen corresponds to the flux of photons incident on the photocathode, except that it is more intense. In other words, to each photon of the flux of photons incident on the photocathode, correspond several photons of the flux of photons outputted by the phosphor screen.

The photocathode and the multiplication means are placed in a vacuum tube provided with an input window to allow the flux of photons incident on the photocathode to pass through. The vacuum tube can be closed by the phosphor screen.

When the flux of photons incident on the photocathode is converted into an initial flux of electrons, the information about the photon wavelength is lost. Thus, the flux of photons outputted by the phosphor screen correspond to a monochrome image.

Document GB 2 302 444 discloses an image intensifier tube capable of restoring a polychromatic image.

A first matrix of primary colour filters is located upstream from the photocathode, to filter an incident flux of photons before it reaches the photocathode.

A primary colour filter is a spectral filter that does not transmit part of the visible spectrum complementary to this primary colour. Thus, a primary colour filter is a spectral filter that transmits part of the visible spectrum corresponding to this primary colour, and possibly a part of the infrared spectrum, and even part of the near-UV spectrum (200 to 400 nm) or even the UV spectrum (10 to 200 nm).

The first matrix of primary colour filters is composed of red, green and blue filters, that draw primary colour pixels on the photocathode. Thus, a flux of photons incident on a given pixel of the photocathode corresponds to a given primary colour. The flux of electrons outputted in response by the photocathode does not contain any chromatic information directly, but corresponds to a given primary colour.

The flux of photons outputted by the phosphor screen, at the output from the intensifier tube, corresponds to white light, a combination of several wavelengths corresponding particularly to red, green and blue. This flux is filtered by a second matrix of primary colour filters. This second matrix draws primary colour pixels on the phosphor screen. Thus, a flux of photons emitted by a given pixel of the phosphor screen is filtered by a primary colour filter. The flux of photons obtained at the output from this primary colour filter corresponds to a given primary colour. The second matrix is identical to the first matrix and is aligned with it. Therefore the pixels on the phosphor screen are aligned with the pixels of the photocathode. Therefore the image produced at the output from the second matrix is composed of pixels for three primary colours corresponding to an intensified image of the pixelated image at the output from the first matrix.

The result is thus an night vision intensifier tube providing a colour image. However, due to the presence of two matrices of primary colour filters, this intensifier tube has high energy losses and this is problematic in a field characterised by the need for strong intensification of a flux of photons.

One objective of this invention is to provide an image acquisition device capable of acquiring colour images while minimising the prejudice caused by energy losses.

PRESENTATION OF THE INVENTION

This objective is achieved with an image acquisition device comprising:

- a photocathode, configured to convert an incident flux of photons into a flux of electrons;
- a sensor composed of a matrix of elements named pixels; and
- processing means.

According to the invention:

- the device comprises a matrix of elementary filters, each associated with at least one pixel of the sensor, said matrix being located upstream from the photocathode, such that an initial flux of photons passes through said matrix before reaching the photocathode;
- the matrix comprises primary colour filters, a primary colour filter not transmitting a part of the visible spectrum complementary to said primary colour, and filters transmitting the entire visible spectrum, named panchromatic filters; and
- the processing means are configured to:
  - calculate a quantity, termed a useful quantity, for determining whether at least one zone of the sensor is under conditions of weak or strong illumination, the useful quantity being representative of a mean surface flux of photons or electrons detected on a set of pixels named panchromatic pixels of the sensor, each panchromatic pixel being associated with a panchromatic filter;
  - forming, only if said zone is under conditions of strong illumination, a colour image of said zone on the basis of the pixels in this zone associated with primary colour pixels.

According to one advantageous embodiment, the photocathode is located inside a vacuum chamber, and the matrix of elementary filters is located on an input window of said vacuum chamber.

As a variant, the photocathode is located inside a vacuum chamber closed by a bundle of optical fibres, and each elementary filter of the matrix of elementary filters is deposited on one end of an optical fibre of said bundle.

The sensor may be a photosensitive sensor, the processing means may be configured to calculate a quantity representative of a mean surface flux of photons, and the device may also comprise:

multiplication means configured to receive the flux of electrons emitted by the photocathode, and supply a secondary flux of electrons in response; and a phosphor screen, configured to receive the secondary flux of electrons and supply a flux of photons in response, named the useful flux of photons, the sensor being arranged to receive said useful flux of photons.

As a variant, the sensor can be a sensor sensitive to electrons, configured to receive the flux of electrons emitted by the photocathode, and the processing means may be configured for calculating a quantity representative of a mean surface flux of electrons.

Preferably, the panchromatic filters represent 75% of the elementary filters.

The matrix of elementary filters is advantageously generated by the periodic two-dimensional repetition of the following pattern:

$$M = \begin{Bmatrix} R & W & G & W \\ W & W & W & W \\ G & W & B & W \\ W & W & W & W \end{Bmatrix}$$

in which R, G, B represent the primary colour filters red, green and blue respectively and W represents a panchromatic filter, the pattern being defined except for an R, G, B permutation.

As a variant, the matrix of elementary filters can be generated by the periodic two-dimensional repetition of the following pattern:

$$M = \begin{Bmatrix} Ye & W & Ma & W \\ W & W & W & W \\ Ma & W & Cy & W \\ W & W & W & W \end{Bmatrix}$$

in which Ye, Ma, Cy represent the primary colour filters yellow, magenta and cyan respectively, and W represents a panchromatic filter, the pattern being defined except for a Ye, Ma, Cy permutation.

The processing means are preferably configured to:

determine that said zone has weak illumination, if the useful quantity is less than a first threshold, and determine that said zone has strong illumination, if the useful quantity is more than a second threshold, the second threshold being higher than the first threshold.

If the useful quantity is between the first and second thresholds, the processing means are advantageously configured to combine a monochrome image and the colour image of said zone, the monochrome image of said zone being obtained from the panchromatic pixels of this zone.

The processing means are preferably configured to:

form a monochrome image from the complete set of panchromatic pixels of the sensor;

segment this monochrome image into homogeneous regions; and for each zone of the sensor associated with a homogeneous region, calculated the corresponding useful quantity independently to determine if said zone is under weak or strong illumination conditions.

The matrix of elementary filters may also include infrared filters that do not transmit the visible part of the spectrum, to each infrared pixel being associated at least one sensor pixel named infrared pixel.

When a zone is under weak illumination conditions, the processing means are advantageously configured to:

compare a predetermined infrared threshold and a quantity, named the secondary quantity, representative of a mean surface flux of photons or electrons detected by the infrared pixels of this zone;

when said secondary quantity is higher than the predetermined infrared threshold, superpose a monochrome image obtained from the panchromatic pixels of this zone and a false colour image obtained from the infrared pixels in this zone.

As a variant, when a zone is under weak illumination conditions, the processing means are advantageously configured to:

starting from the infrared pixels in this zone, identify sub-zones of this zone which detect a mean surface flux of photons or electrons homogeneous in the infrared spectrum;

for each sub-zone thus identified, compare a predetermined infrared threshold and a quantity named the secondary quantity representative of a mean surface flux of photons or electrons detected by the infrared pixels of this sub-zone;

when said secondary quantity is higher than the predetermined infrared threshold, superpose a monochrome image obtained from the panchromatic pixels of this sub-zone and a false colour image obtained from the infrared pixels in this sub-zone.

The matrix of elementary filters can consist of a image projected by an optical projection system.

The invention also relates to an image formation method, implemented in a device comprising a photocathode configured to convert an incident flux of photons into an flux of electrons, and a sensor, the method including the following steps:

filter an initial flux of photons to obtain said incident flux of photons, this filtering making use of a matrix of elementary filters including primary colour filters, a primary colour filter not transmitting a part of the visible spectrum complementary to said primary colour, and filters transmitting the entire visible spectrum, named panchromatic filters;

calculate a quantity, termed a useful quantity, for determining whether at least one zone of the sensor is under conditions of weak or strong illumination, the useful quantity being representative of a mean surface flux of photons or of electrons detected on a set of pixels named panchromatic pixels of the sensor, each panchromatic pixel being associated with a panchromatic filter;

form, only if said zone is under conditions of strong illumination, a colour image of said zone on the basis of the pixels in this zone associated with primary colour filters.

BRIEF DESCRIPTION OF THE DRAWINGS

This invention will be better understood after reading the description of example embodiments given purely for information and that are in no way limitative with reference to the appended drawings on which:

FIGS. 3A and 3B diagrammatically illustrate two variants of a first embodiment of a matrix of elementary filters according to the invention;

DETAILED PRESENTATION OF PARTICULAR EMBODIMENTS

Figure 1:
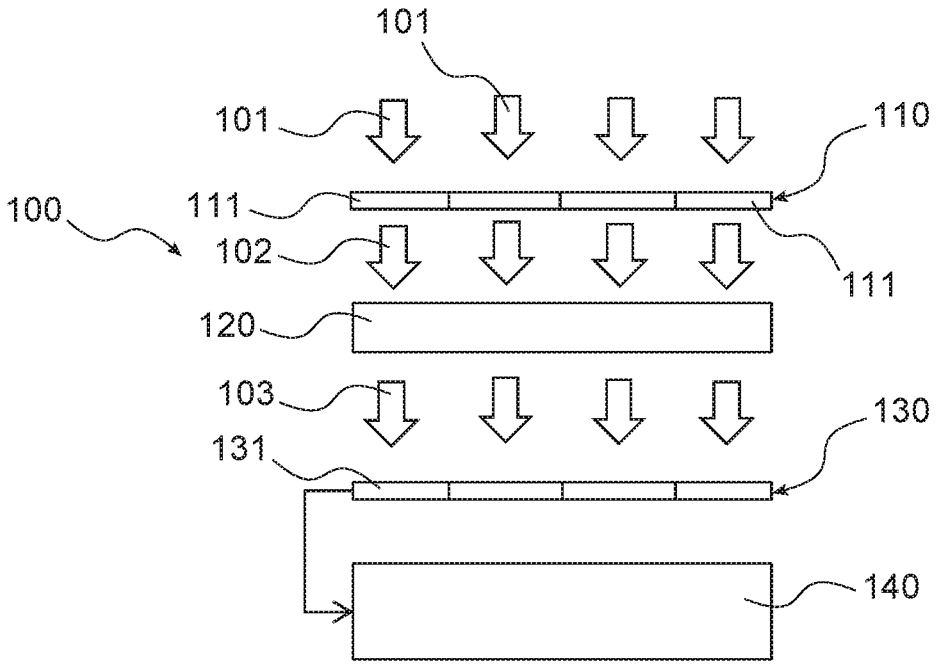
FIG. 1 diagrammatically illustrates the principle of a device according to the invention.

FIG. 1 diagrammatically illustrates the principle of an image acquisition device 100 according to the invention;

The device 100 comprises a photocathode 120 operating as described in the introduction, and a matrix 110 of elementary filters 111 located upstream from the photocathode. For example, a GaAs (gallium arsenide) photocathode may be used. Any other type of photocathode can be used, and particularly photocathodes sensitive in the widest possible spectrum of wavelengths, including the visible (about 400 to 800 nm), and possibly the near infra-red or even the infra-red, and/or the near UV (ultra-violet), or even the UV.

Each elementary filter 111 filters incident light on a location on the photocathode 120. Each elementary filter 111 thus defines a pixel on the photocathode 120.

The elementary filters 111 are transmission filters in at least two different categories: primary colour filters and transparent (or panchromatic) filters.

A primary colour elementary filter is defined in the introduction. Elementary filters of the matrix 110 include three types of primary colour filters, in other words filters of three primary colours. This enables an additive or subtractive synthesis of all colours in the visible spectrum. In particular, each type of primary colour filter transmits only part of the visible spectrum, in other words a band of a 400-700 nm interval of wavelengths, and the different types of primary colour pixels together cover this entire interval. In addition to part of the visible spectrum, each primary colour filter can transmit part of the near infrared or even infrared spectrum and/or part of the near-UV or even UV spectrum. The colour filters can be red, green, blue filters in the case of additive synthesis, or yellow, magenta, cyan filters in the case of subtractive synthesis. Other sets of primary colour can be implemented by the man skilled in the art without going outside the framework of this invention.

Panchromatic elementary filters allow the entire visible spectrum to pass through. If applicable, they can also transmit at least part of the near infrared or even infrared spectrum and/or part of the near-UV or even UV spectrum. Panchromatic elementary filters can be elements transparent in the visible, or can be openings in the matrix 110. In this second case, the pixels of the photocathode located under these panchromatic elementary filters receive unfiltered light.

The different types of primary colour filters and the panchromatic filters are distributed sparsely on the matrix of elementary filters.

The elementary filters are advantageously arranged in the form of a pattern, periodically repeating along two distinct directions usually orthogonal, in the plane of the photocathode 120. Each pattern preferably comprises at least one primary colour filter of each type, and panchromatic filters.

Although the illustrated elementary filters are square, they can be in any geometric shape, for example in the form of a hexagon, a disk or a surface defined as a function of constraints related to the transfer function of the device 100 according to the invention.

The matrix of elementary filters according to the invention can be real or virtual.

The matrix of elementary filters is said to be real when it is composed of elementary filters with a certain thickness, for example elementary filters made of a polymer material or interference filters.

The matrix of elementary filters is said to be virtual when it is composed of an image of a second matrix of elementary filters projected on the upstream side of the photocathode. In this case, the second matrix of elementary filters consists of a real matrix of elementary filters. It is located in the object plane of an optical projection system. The image formed in the image plane of this optical projection system corresponds to said virtual matrix of elementary filters. One advantage of this variant is that it avoids difficulties with positioning a real matrix at the required location.

The example of a real matrix of elementary filters has been developed in all the examples developed with reference to the figures. Many variants could be implemented, replacing the real matrix of elementary filters by a virtual matrix of elementary filters. Preferably, the device according to the invention will then include the second matrix of elementary filters and the optical projection system as mentioned above.

Preferably but non-limitatively, the proportion of panchromatic elementary filters in the matrix 110 is greater than or equal to 50%. Advantageously, the proportion of panchromatic elementary filters is equal to 75%. Primary colour elementary filters can be distributed in equal proportions. As a variant, primary colour elementary filters are distributed in unequal proportions. Preferably, the proportion of a first type of primary colour filter is not more than twice the proportion of other types of primary colour filters. For example, the proportion of panchromatic elementary filters is equal to 75%, the proportion of filters of a first primary colour is equal to 12.5%, and the proportions of filters of second and third primary colours are equal to 6.25% and 6.25% respectively.

The matrix 120 receives an initial flux of photons. For illustrative purposes, the initial elementary fluxes of photons 101 are represented, each associated with an elementary filter 111. The initial elementary fluxes of photons 101 together form a polychromatic image, and can include photons located in the visible, near infrared and even infrared spectrum.

An elementary filter 111 transmits a filtered elementary flux 102, the filtered elementary fluxes together forming a flux of photons incident on the photocathode. The photocathode 120 emits an flux of electrons in response to this incident flux of photons. There is an elementary flux of electrons 103 that corresponds to each filtered elementary flux 102. The more photons the filtered elementary flux 102 contains, the more important is the corresponding flux of electrons 103. The elementary fluxes of electrons 103 do not transport any chromatic information directly, but depend directly on a number of photons transmitted by a corresponding elementary filter 111. The elementary fluxes of electrons 103 together form a flux of electrons emitted by the photocathode 120.

The device 100 according to the invention also comprises a digital sensor 130. As described in detail below, the sensor 130 can directly receive the flux of electrons emitted by the photocathode 120. As a variant, this flux of electrons emitted by the photocathode 120 can be converted into a flux of photons such that the sensor 130 finally receives a flux of photons. Since FIG. 1 is an illustration showing the principle only of the invention, the sensor 130 is shown directly after the photocathode 120. The sensor 130 may be a sensor sensitive to photons or to electrons, and other elements can be inserted between the photocathode 120 and the sensor 130.

The sensor is sensitive to electrons as emitted by the photocathode, or to photons obtained from these electrons.

Preferably, the sensor is sensitive to:

photons in the 400-900 nm band, or even 400-1100 nm, or even a spectral band varying from the UV to the near infrared, for example 200-1100 nm; or electrons originating from photons within this band. The sensor is composed of a matrix of elements named pixels 131, sensitive to photons or to electrons.

Each elementary filter 111 is associated with at least one pixel 131 of the sensor. In other words, each elementary filter 111 is aligned with at least one pixel 131 of the sensor, such that the largest part of a flux of electrons or photons, resulting from photons transmitted by this elementary filter 111 reaches this at least one pixel 131. Each elementary filter 111 is preferably associated with exactly one pixel 131 of the sensor. Preferably, the area of an elementary filter 111 corresponds to the area of a pixel 131 of the sensor or an area corresponding to the juxtaposition of an integer number of pixels 131 of the sensor.

Since each elementary filter 111 is associated with at least one pixel 131 of the sensor, a pixel of the sensor associated with a panchromatic elementary filter can be named a "panchromatic pixel" and a pixel of the sensor associated with a primary colour elementary filter can be named a "primary colour pixel". Panchromatic pixels detect electrons or photons associated with the spectral band transmitted by the panchromatic filters. Each type of primary colour pixel detects electrons or photons associated with the spectral band transmitted by the corresponding type of primary colour filter.

The sensor 130 is connected to processing means 140, in other words to calculation means including particularly a processor or a microprocessor. The processing means 140 receive, as input, electrical signals outputted by the sensor 130, corresponding for each pixel 131 to the flux of photons received and detected by this pixel when the sensor is sensitive to photons, or to the flux of electrons received and detected by this pixel when the sensor is sensitive to electrons. The processing means 140 supply an image at the output corresponding to the initial flux of photons incident on the matrix of elementary filters, this flux having been intensified.

The processing means 140 are configured to assign, to each pixel of the sensor, information about a type of elementary filter associated with said pixel. To this end, they store information for associating each pixel of the sensor with a type of elementary filter. This information may be in the form of a deconvolution matrix. Thus, spectral information that is lost when passing through the photocathode, is restored by the processing means 140.

Figure 2:
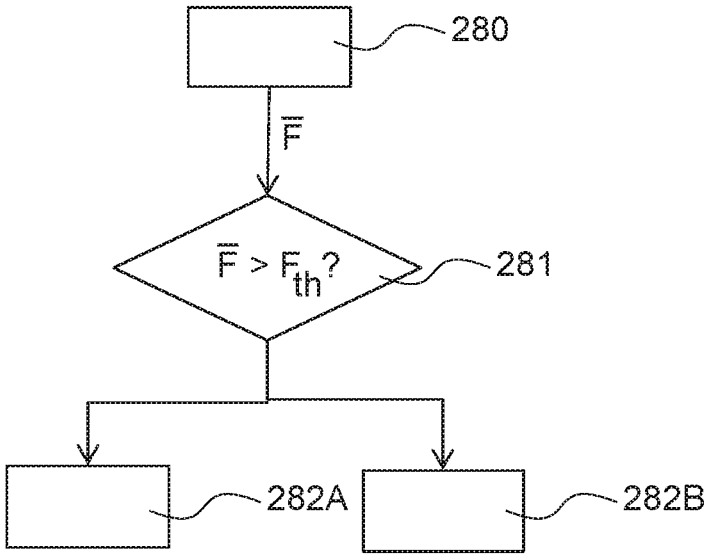
FIG. 2 diagrammatically illustrates a first embodiment of processing implemented by processing means according to the invention.

The processing means 140 are configured to implement processing as illustrated in FIG. 2.

According to the first embodiment described below, the processing means create a monochrome image by interpolation of all panchromatic pixels of the sensor. This image is named the "monochrome image of the sensor". They then create segmentation of the sensor into several zones, each zone being homogeneous in terms of the flux of photons or electrons detected by the corresponding panchromatic pixels.

An example of a segmentation of this type is described in the paper by S. Tripathi et al. entitled "Image Segmentation: a review" published in International Journal of Computer Science and Management Research, vol. 1, No 4, November 2012, pp. 838-843.

The processing means then implement the following steps.

A first step 280 estimates a quantity $\overline{F}$ representative of a mean surface flux of photons or electrons received and detected by the panchromatic pixels in a zone of the sensor, sensitive to photons or electrons respectively.

This quantity is named a "useful quantity". The useful quantity can be equal to said mean surface flux of photons or electrons. If the sensor 130 is sensitive to photons, the useful quantity can be a mean luminance on the panchromatic pixels in the zone of the sensor. Thus, the useful quantity can be a mean surface flux of photons or electrons detected on a set of so-called panchromatic pixels of the sensor.

Therefore it can be considered that the useful quantity provides a measurement of the illumination on said zone of the sensor.

Weak illumination conditions are associated with a low value of the useful quantity (as an absolute value). Strong illumination conditions are associated with a high value of the useful quantity (as an absolute value).

Strong illumination conditions are associated for example with a light illumination greater than a first threshold between 450 and 550 μLux. Weak illumination conditions are associated for example with a light illumination less than a second threshold between 400 and 550 μLux, and the first and second thresholds can be equal. If the first and second thresholds are not equal, the first threshold is strictly higher than the second threshold.

A second step 281 compares the useful quantity $\overline{F}$ and a threshold value $F_{th}$. If the useful quantity $\overline{F}$ is higher than the threshold value $F_{th}$, the sensor zone is under strong illumination conditions. If the useful quantity $\overline{F}$ is lower than the threshold value $F_{th}$, the sensor zone is under weak illumination conditions.

Steps 280 and 281 together form a step to determine if the zone of the sensor 130 is under weak or strong illumination conditions.

Strong illumination may for example occur when a night scene image illuminated by the moon (night level 1 to 3) is acquired. Weak illumination may for example occur during when a night scene image, not illuminated by the moon (night level 4 to 5, namely light illumination less than 500 μLux) is acquired.

If the zone is under strong illumination conditions, a colour image of this zone is formed using the primary colour pixels of this zone (step 282A). It is said that the device is operating in the strong illumination operating mode.

In particular, an image of each primary colour is formed and the images of each primary colour are combined together. A primary colour image is formed by interpolation of the pixels of this zone associated with said primary colour. Interpolation can overcome the problem of the small proportion of sensor pixels of a given primary colour. Interpolation of pixels of a primary colour consists of using values of these pixels to estimate the values that adjacent pixels would have had if they were also pixels of this primary colour.

Optional processing can be done on primary colour images to sharpen them (image sharpening). For example, a monochrome image of the zone can be obtained by interpolating the panchromatic pixels of this zone, and combining this monochrome image, possibly after a high pass filtering, with each primary colour image of this same zone. Since the proportion of panchromatic pixels in the matrix is much higher than the proportion of primary colour pixels, the resolution of primary colour images is thus improved.

If the zone is under conditions of weak illumination, a monochrome image of said zone is formed using the panchromatic pixels of this zone. In particular, a monochrome image is formed using panchromatic pixels of this zone (step 282B), without using primary colour pixels of this zone. Once again, the monochrome image can be obtained by interpolation of panchromatic pixels in this zone. It is said that the device is operating in the weak illumination operating mode.

It is important to note that the distinction between weak illumination and strong illumination is based on a measurement made from panchromatic pixels of the sensor, and therefore for the entire spectrum detected by such a sensor, in other words for at least all of the visible spectrum.

These steps are performed for each previously identified zone of the sensor.

Colour or monochrome images of the different zones of the sensor are then combined to obtain an image from the entire sensor. The image from the entire sensor can then be displayed or stored in a memory to be processed later.

As a variant, a colour image of each strong illumination zone is formed, and then the zones corresponding to these strong illumination zones are replaced by the colour images of these zones in the monochrome image of the sensor used for segmentation.

According to another variant, a linear combination is made of the monochrome image of the sensor and these colour images. Thus, the colour image and the monochrome image are superposed in the strong illumination regions.

In the example described above, the zones of the sensor are processed separately As a variant, it is determined if the entire sensor is under weak or strong illumination conditions, and the entire sensor is processed in the same manner. In this case, there is no segmentation of the monochrome image of the sensor, and no combination of the images obtained. Steps 280, 281 and 282A or 282B are applied over the entire surface area of the sensor. In other words, the sensor zone as mentioned above corresponds to the entire sensor.

Thus, the processing means 140 receive signals from the sensor as input, store information to associate each pixel in the sensor with a type of elementary filter, and provide an output consisting of a colour image or a monochrome image or a combination of a colour image and a monochrome image.

The invention thus discloses an image acquisition system configured to acquire a colour image of a zone of the sensor when possible, depending on the illumination of the detected scene on this zone. When this illumination becomes insufficient, the device provides an image of the zone obtained from panchromatic elementary filters, and therefore with a minimum energy loss. The device automatically selects one or the other operating mode.

It will be noted that there is no second matrix of elementary filters present on the sensor 130, because it is sufficient to consider during, the processing, that a specific pixel of the sensor is associated with a specific elementary filter upstream from the photocathode. The result obtained is thus an image acquisition device with a high energy efficiency.

According to a first variant of this first embodiment, the switching from one operating mode to the other takes place with hysteresis to avoid switching noise (chattering). To achieve this, a first threshold for the useful quantity is provided for the transition from strong illumination mode to weak illumination mode, and a second threshold for the useful quantity is provided for the reverse transition, the first threshold being chosen to be lower than the second threshold.

According to a second variant of the first embodiment, the switching from one mode to the other takes place progressively, passing through a transition phase. Thus, the image acquisition device operates in weak illumination mode when the useful quantity is less than a first threshold and in strong illumination mode when the useful quantity is more than a second threshold chosen to be higher than the first threshold. When the useful quantity is between the first and the second thresholds, the image acquisition device makes a linear combination of the image obtained by processing in strong illumination mode and the image obtained by processing in weak illumination mode, the weighting coefficients being given by the differences of the useful quantity with the first and second thresholds respectively.

Ideally, each elementary filter 111 is aligned with at least one pixel 131 of the sensor, such that each pixel of the sensor associated with an elementary filter only receives photons or electrons corresponding to this elementary filter. However, there can be spatial spreading due to the propagation through the device according to the invention, and particularly spatial spreading of the flux of electrons emitted by the photocathode. This disadvantage can be mitigated by an initial calibration step so that alignment defects between an elementary filter and a sensor pixel can be compensated later. This calibration is aimed at compensating the slight degradation due to the transfer function of the optical elements of the device according to the invention (photocathode and possibly multiplication means and phosphor screen). During this calibration, the matrix of elementary filters is illuminated by different monochromatic light beams one after the other (each corresponding to one of the primary colours of the primary colour filters), and the signal received by the sensor 130 is measured. The next step is to deduce a deconvolution matrix that is stored by the processing means 140. During operation, the processing means 140 multiply the signals transmitted by the sensor, by this deconvolution matrix. Thus, after multiplication by the deconvolution matrix, the signals are reconstructed as they would be transmitted by the sensor under ideal conditions, without any spatial spreading. Each primary colour filter (and possibly each infrared filter, see below) is preferably fully surrounded by panchromatic filters. Thus, calibration is simplified in the case of spatial spreading of the flux of electrons emitted by the photocathode.

As a variant or as a complement, the geometric shape of the filters making up the matrix of elementary filters is calibrated so as to compensate the effect of said spatial spreading. After deformation by optical elements of the device according to the invention (photocathode and possibly multiplication means and phosphor screen), the image of an elementary filter is then perfectly superposed on one or several pixels of the sensor.

Interstices between adjacent elementary filters are advantageously opaque, so as to block all radiation that could otherwise reach the photocathode without having passed through an elementary filter.

FIGS. 3A and 3B diagrammatically illustrate two variants of a first embodiment of a matrix 110 of elementary filters according to the invention;

On FIG. 3A, the primary colour elementary filters are red (R), green (G) or blue (B) filters. The matrix includes 75% of panchromatic filters (W).

The matrix 110 is generated by a two-dimensional periodic repetition of the basic 4×4 pattern:

$$\begin{Bmatrix} R & W & G & W \\ W & W & W & W \\ G & W & B & W \\ W & W & W & W \end{Bmatrix} \quad (1)$$

Variants of this matrix can be obtained by permutation of the R, G, B filters in the pattern (1). There are twice as many green pixels as there are red or blue pixels. This unbalance can be corrected by appropriate weighting factors when combining three primary colour images to form a colour image.

The matrix in FIG. 3B corresponds to the matrix in FIG. 3A, in which the R, G, B primary colour elementary filters are replaced by yellow (Ye), magenta (Ma), and cyan (Cy) primary colour elementary filters. Once again, the Ye, Ma, Cy filters can be permuted.

According to one variant (not shown) of the matrix represented in FIG. 3A, the panchromatic filters represent 50% of the elementary filters, and the elementary pattern is as follows:

$$\begin{Bmatrix} W & R & W & G \\ R & W & X & W \\ W & G & W & B \\ Y & W & B & W \end{Bmatrix} \quad (2)$$

where X=R, G or B, Y=R, G or B, and Y≠X.

Once again, the R, G, B filters can be permuted.

As a variant, the R, G, B filters in pattern (2) are replaced by the Ye, Ma, Cy filters.

Figure 4:
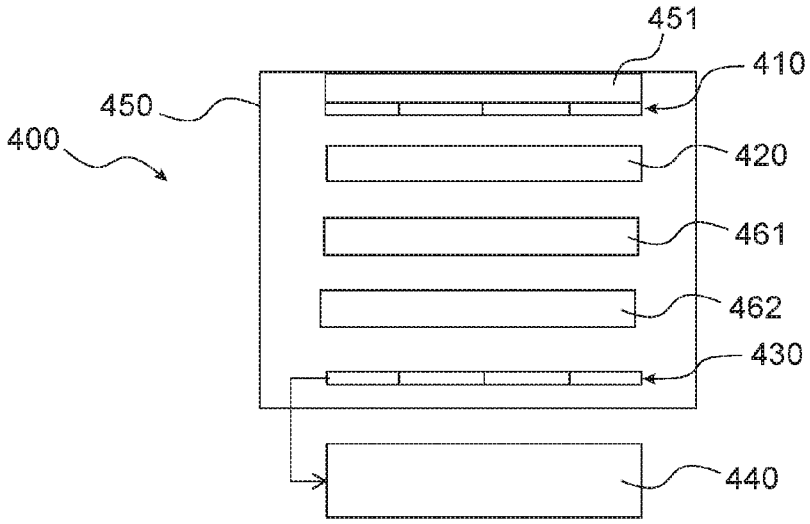
FIG. 4 diagrammatically illustrates a first embodiment of a device according to the invention.

FIG. 4 diagrammatically illustrates a first embodiment of a device 400 according to the invention. Only the differences between FIG. 4 and FIG. 1 will be described. The use of a calibration step as described above is particularly advantageous in this embodiment.

The device 400 is based on the Intensified CMOS" (ICMOS) or "Intensified CCD" (ICCD) technology.

The photocathode 420 is placed inside a vacuum tube 450, of the type of a vacuum tube of an image intensifier tube according to prior art as described in the introduction. A vacuum tube refers to a vacuum chamber specifically in the shape of a tube.

The vacuum tube 450 has an input window 451, transparent particularly in the visible, and possibly in the near infrared or even the infrared. The input window allows the flux of photons incident on the photocathode to enter inside the vacuum tube. The input window can be made particularly of glass. The input window is preferably a single plate. The matrix of elementary filters 410 is glued on one face of the input window 451, and preferably on the inside of the vacuum tube. The photocathode is pressed against the matrix of elementary filters 410. A metallic layer (not shown) can be deposited on the input window, around the matrix of elementary filters 410, so as to form a point of electrical contact for application of an electrostatic field.

There are multiplication means 461 and a phosphor screen 462 as described in the introduction, downstream from the photocathode 420.

The phosphor screen emits a flux of photons, named a useful flux, that is received by the sensor 430. The sensor 430 is photosensitive. In particular, it may be a CCD (Charge-Coupled Device) sensor or a CMOS (Complementary Metal Oxide Semiconductor) sensor. On FIG. 4, the sensor 430 is shown inside the vacuum tube, electronic connections between the sensor 430 and the processing means 440 passing through the tube.

The processing means 440 operate as described with reference to FIG. 2, the useful quantity being representative of the surface flux of photons detected by the panchromatic pixels of the sensor 430.

The sensor 430 can be in direct contact with the phosphor screen to limit possible spatial spreading of the photon beam emitted by the phosphor screen. In this case, the sensor 430 can be inside the vacuum tube, or outside it and pressed against an output face of the vacuum tube formed by the phosphor screen.

The sensor 430 can be mounted outside the vacuum tube 450.

In particular, a bundle of optical fibres can connect the phosphor screen and the pixels of sensor 430, the bundle of optical fibres forming an output window from the vacuum tube. Such a bundle of optical fibres is particularly suitable in the case in which the surface area of the sensor 430 is less than the inside diameter of the vacuum tube. In this case, the diameter of each fibre at the phosphor screen end is greater than its diameter at the sensor end. The bundle of optical fibres is said to be thinning, and reduces the image outputted by the phosphor screen.

Figure 5A:
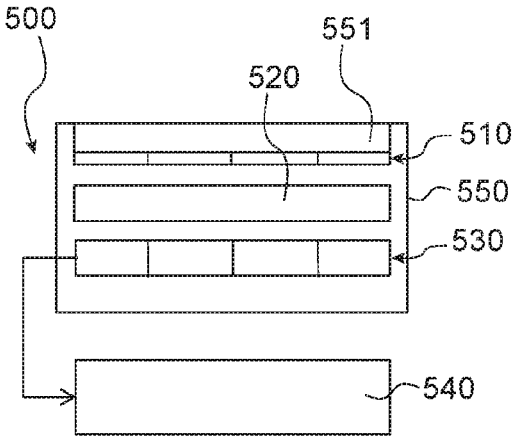
FIGS. 5A and 5B diagrammatically illustrate two variants of a second embodiment of a device according to the invention.
Figure 5B:
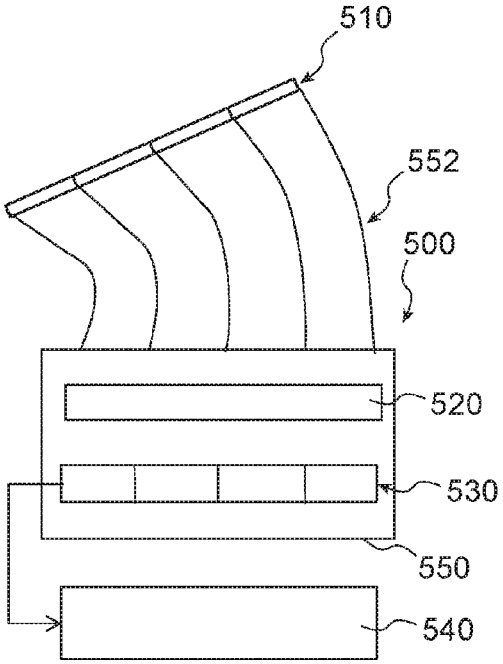

FIGS. 5A and 5B diagrammatically illustrate two variants of a second embodiment of a device 500 according to the invention.

Only the differences between FIG. 5A and FIG. 1 will be described.

The device 500 is based on the EBCMOS (Electron Bombarded CMOS) technology.

The photocathode 520 is located inside a vacuum tube 550.

The vacuum tube 550 has an input window 551, transparent particularly in the visible, and possibly in the near infrared or even the infrared.

The matrix of elementary filters 510 is glued on one face of the input window 551, and preferably on the inside of the vacuum tube.

The sensor 530 is located inside the vacuum tube 550, and directly receives the flux of electrons emitted by the photocathode.

The photocathode 520 and the sensor 530 are a few millimeters from each other and a difference in potential is applied to them to create an electrostatic field in the interstice separating them. This electrostatic field can accelerate electrons emitted by the photocathode 520 towards the sensor 530.

The sensor 530 is sensitive to electrons. It is typically a CMOS sensor, adapted to make it sensitive to electrons.

According to a first variant, the sensor sensitive to electrons is back side illuminated. This can be achieved using a CMOS sensor with a thinned and passivated (back-thinned) substrate. The sensor can include a passivation layer, forming an external layer at the photocathode side. The passivation layer is deposited on the thinned substrate. The substrate receives detection diodes, each associated with a pixel of the sensor.

According to a second variant, the sensor sensitive to electrons is illuminated on the front side. This can be done using a CMOS sensor for which the front side is treated so as to remove protective layers covering the diodes. The front side of a standard CMOS sensor is thus made sensitive to electrons. The processing means 540 operate as described with reference to FIG. 2, the useful quantity being representative of the surface flux of electrons detected by the panchromatic pixels of the sensor 530.

FIG. 5B illustrates a variant of the device 500 of FIG. 5A, in which the vacuum tube 550 is closed by a bundle 552 of optical fibres receiving the matrix of elementary filters.

According to this variant, photons from the scene for which an image is required pass through the bundle 552 of optical fibres. A first end of the bundle 552 of optical fibres closes the vacuum tube. A second end of the bundle 552 of optical fibres is located facing the scene for which an image is required. The vacuum tube no longer has an input window 551, said window being replaced by the bundle of optical fibres such that the vacuum tube can be located remoted from the scene for which the image is required.

Each elementary filter of the matrix 510 is associated with one optical fibre in the bundle 552. In particular, each elementary filter is directly fixed to one end of the optical fibre, advantageously the end opposite the vacuum tube. In this case, the matrix of elementary filters 510 is located outside the vacuum tube, which simplifies its installation.

As a variant, each elementary filter is directly fixed to one end of the optical fibre, at the same end as the vacuum tube. A variant of the device described with reference to FIG. 4 can be made in the same way.

Figures 6, 7:
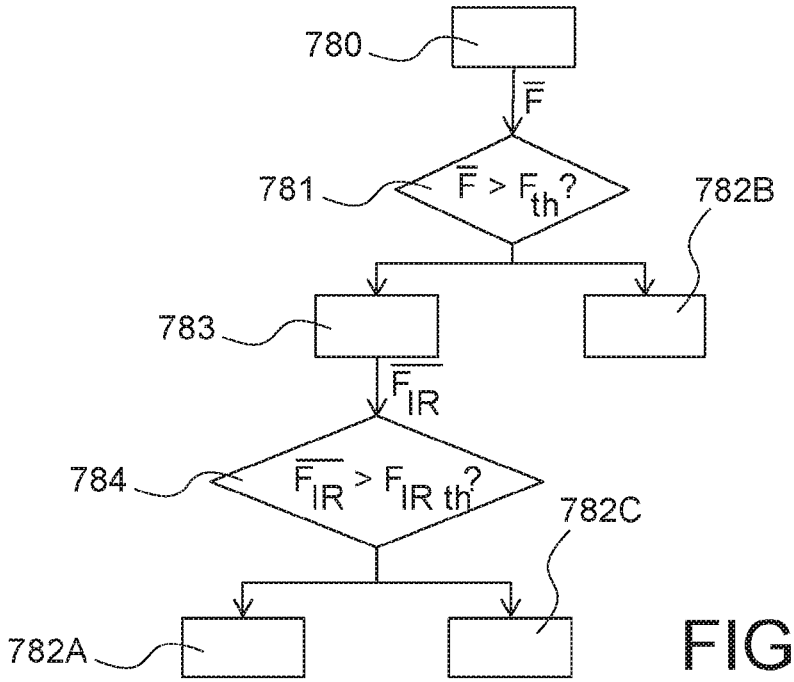
FIG. 6 diagrammatically illustrates a second embodiment of a matrix of elementary filters according to the invention.
FIG. 7 diagrammatically illustrates a second embodiment of processing implemented by processing means according to the invention.

FIG. 6 diagrammatically illustrates a second embodiment of a matrix of elementary filters according to the invention. The matrix of elementary filters in FIG. 6 is different from the previously described matrices in that it includes infrared (IR) filters that do not transmit the visible part of the spectrum and allow the near infrared to pass through. The infrared filters allow wavelengths in the near infrared to pass through, and possibly also wavelengths in the infrared (wavelengths higher than 700 nm). In particular, the infrared filters transmit the spectral band between 700 and 900 nm, possibly between 700 and 1100 nm, and even between 700 and 1700 nm.

The filter matrix in FIG. 6 is different from the matrix in FIG. 3A in that one of the two green (G) pixels in the elementary pattern is replaced by an infrared (IR) pixel.

Different variants of the matrix in FIG. 6 can be formed in the same way, for example starting from the matrix in FIG. 3B and replacing one of the two magenta pixels in the elementary pattern by an infrared pixel.

According to other variants, the elementary pattern (2) as defined above is used, defining X=Y=IR.

FIG. 7 diagrammatically illustrates processing implemented by the processing means according to the invention, when the matrix of elementary filters includes infrared pixels.

Steps 780, 781 and 782B correspond to steps 280, 281 and 282B respectively as described with reference to FIG. 2.

When a zone of the sensor is located under weak illumination conditions, the processing means measure a quantity named the secondary quantity, representative of the mean surface flux of photons or electrons $\overline{F_{IR}}$ detected by infrared pixels in this zone (step 783). In particular, this mean surface flux is a mean surface flux of photons if the sensor is photosensitive, or a mean surface flux of electrons if the sensor is sensitive to electrons.

The processing means then compare this secondary quantity and an infrared threshold $F_{IR\ th}$ (step 784).

If the secondary quantity $\overline{F_{IR}}$ is less than the infrared threshold $F_{IR\ th}$, a colour image of the zone is built up as described with reference to FIG. 2 in the description of step 282A (step 782A).

If the secondary quantity $\overline{F_{IR}}$ is higher than the infrared threshold $F_{IR\ th}$, a false colour image of the zone is built up, in other words an image in which a given colour is assigned to infrared pixels in this zone. The false colour image can be constructed by interpolation of infrared pixels of the zone considered. Therefore the false colour image is a monochrome image with a colour different from the monochrome image associated with panchromatic pixels. This false colour image is then superposed on the monochrome image obtained using panchromatic pixels in the same zone of the sensor.

These steps in the construction of a false colour image and superposition with the monochrome image together form a step 782C.

Thus, for a zone under weak illumination conditions, the result obtained will be either a monochrome image or superposed images as defined above.

In summary, when a zone is under weak illumination conditions, it is tested if the infrared pixels in this zone have an intensity higher than a predetermined infrared threshold and if so, the infrared pixels represented in false colour are superposed on the monochrome image of this zone. This embodiment is particularly advantageous for laser detection applications.

According to a first variant, a single secondary quantity is not calculated for an entire zone, but a secondary quantity is calculated separately for each infrared pixel in the zone. Only infrared pixels for which the corresponding secondary quantity is higher than the infrared threshold are superposed on the monochrome image obtained from the panchromatic pixels. Thus, if a sensor zone has a high intensity in the infrared range, it will be easily identifiable in the resulting image.

According to another variant, sub-zones of said sensor zone are identified, which detect an homogeneous mean surface flux of pixels or electrons in the infrared spectrum, and each sub-zone is then processed separately as described above. In other words, the comparison with the infrared threshold is made by homogeneous sub-zones of the sensor. A false colour image is obtained for each sub-zone of the sensor for which the secondary quantity is higher than the infrared threshold, by interpolation of infrared pixels in said sub-zone. These false colour images are then superposed on the corresponding locations on the monochrome image of the zone of the sensor. A segmentation is made based on an image made by interpolation of infrared pixels, to identify such sub-zones. In summary, when a zone is under weak illumination conditions, sub-zones of this zone are identified which have homogeneous intensity in the infrared spectrum, and for each sub-zone thus identified, it is determined if the mean infrared intensity in this sub-zone is higher than a predetermined infrared threshold and if it is, this sub-zone is represented by a false colour image based on the infrared pixels in this sub-zone, the false colour image of said sub-zone then being represented superposed with the monochrome image of the zone to which it belongs.

The infrared pixels of the sensor can also be used to improve a signal-to-noise ratio on a final colour image. When a zone of the sensor is under strong illumination conditions, this is done by making an infrared image of this zone by interpolation of infrared pixels of the sensor. This infrared image is then subtracted from the colour image of this zone, obtained as described in detail with reference to FIG. 2. Subtraction of the infrared image can improve the signal-to-noise ratio. A weighted infrared image can be subtracted from each primary colour image, to avoid saturation problems. Weighting coefficients attributed to the infrared image may or may not be identical for each primary colour image. Primary colour images from which noise has been removed are thus obtained, and are combined to form a colour image without noise. The processing means are thus configured to implement the following steps:

calculate the useful quantity to determine if at least one zone of the sensor is under weak or strong illumination conditions;

if and only if said zone is under strong illumination conditions, form a colour image of said zone starting from pixels of this zone associated with primary colour filters, and subtract from this colour image an infrared image of said zone obtained from infrared pixels of this zone (for example by interpolation of said infrared pixels).

What is claimed is:

1. Image acquisition device comprising:

a photocathode, configured to convert an incident flux of photons into a flux of electrons;

a sensor composed of a matrix of elements named pixels; and a processor;

wherein:

the device comprises a matrix of elementary filters, each associated with at least one pixel of the sensor, said matrix being located upstream from the photocathode, such that an initial flux of photons passes through said matrix before reaching the photocathode;

the matrix comprises primary color filters (R, G, B; Ye, Ma, Cy), a primary color filter not transmitting a part of the visible spectrum complementary to said primary color, and filters transmitting the entire visible spectrum, named panchromatic filters; and the processor is configured to:

calculate a quantity, termed a useful quantity, for determining whether at least one zone of the sensor is under conditions of weak or strong illumination, the useful quantity being representative of a mean surface flux of photons or electrons detected on a set of pixels named panchromatic pixels of the sensor, each panchromatic pixel being associated with a panchromatic filter; and forming, only if said zone is under conditions of strong illumination, a color image of said zone on the basis of the pixels in this zone associated with primary color pixels.

2. Device according to claim 1, wherein the photocathode is located inside a vacuum chamber, and in that the matrix of elementary filters is located on an input window of said vacuum chamber.

3. Device according to claim 1, wherein the photocathode is located inside a vacuum chamber closed by a bundle of optical fibers, and in that each elementary filter of the matrix of elementary filters is deposited on one end of an optical fiber of said bundle.

4. Device according to claim 1, wherein the sensor is a photosensitive sensor, the processor is configured to calculate a quantity representative of a mean surface flux of photons, and the device also comprises:

a multiplier configured to receive the flux of electrons emitted by the photocathode, and supply a secondary flux of electrons in response; and a phosphor screen, configured to receive the secondary flux of electrons and supply a flux of photons in response, named the useful flux of photons, the sensor being arranged to receive said useful flux of photons.

5. Device according to claim 1, wherein the sensor is a sensor sensitive to electrons, configured to receive the flux of electrons emitted by the photocathode, and the processor is configured to calculate a quantity representative of a mean surface flux of electrons.

6. Device according to claim 1, wherein the panchromatic filters represent 75% of the elementary filters.

7. Device according to claim 6, wherein the matrix of elementary filters is generated by the periodic two-dimensional repetition of the following pattern:

$$M = \begin{Bmatrix} R & W & G & W \\ W & W & W & W \\ G & W & B & W \\ W & W & W & W \end{Bmatrix}$$

in which R, G, B represent the primary color filters red, green and blue respectively and W represents a panchromatic filter, the pattern being defined except for an R, G, B permutation.

8. Device according to claim 6, wherein the matrix of elementary filters is generated by the periodic two-dimensional repetition of the following pattern:

$$M = \begin{Bmatrix} Ye & W & Ma & W \\ W & W & W & W \\ Ma & W & Cy & W \\ W & W & W & W \end{Bmatrix}$$

in which Ye, Ma, Cy represent the primary color filters yellow, magenta and cyan respectively, and W represents a panchromatic filter, the pattern being defined except for a Ye, Ma, Cy permutation.

9. Image acquisition device according to claim 1, wherein the processor is configured to:

determine that said zone has weak illumination, if the useful quantity is less than a first threshold, and determine that said zone has strong illumination, if the useful quantity is more than a second threshold, the second threshold being higher than the first threshold.

10. Device according to claim 9, wherein if the useful quantity is between the first and second thresholds, the processor is configured to combine a monochrome image and the color image of said zone, the monochrome image of said zone being obtained from the panchromatic pixels of the zone.

11. Image acquisition device according to claim 1, wherein the processor is configured to:

form a monochrome image from the complete set of panchromatic pixels of the sensor;

segment the monochrome image into homogeneous regions; and for each zone of the sensor associated with a homogeneous region, calculate the corresponding useful quantity independently to determine if said zone is under weak or strong illumination conditions.

12. Image acquisition device according to claim 1, wherein the matrix of elementary filters also includes infrared filters that do not transmit the visible part of the spectrum, wherein each infrared filter is associated with least one sensor pixel named infrared pixel.

13. Image acquisition device according to claim 12, wherein, when a zone is under weak illumination conditions, the processor is configured to:

compare a predetermined infrared threshold and a quantity named the secondary quantity, representative of a mean surface flux of photons or electrons detected by the infrared pixels of the zone; and when said secondary quantity is higher than the predetermined infrared threshold, superpose a monochrome image obtained from the panchromatic pixels of the zone and a false color image obtained from the infrared pixels of the zone.

14. Image acquisition device according to claim 12, wherein, when a zone is under weak illumination conditions, the processor is configured to:

starting from the infrared pixels in the zone, identify sub-zones of the zone, which detect a mean surface flux of photons or electrons homogeneous in the infrared spectrum;

for each sub-zone thus identified, compare a predetermined infrared threshold and a quantity named the secondary quantity, representative of a mean surface flux of photons or electrons detected by the infrared pixels of the sub-zone; and when said secondary quantity is higher than the predetermined infrared threshold, superpose a monochrome image obtained from the panchromatic pixels of the sub-zone and a false color image obtained from the infrared pixels in the sub-zone.

15. Image acquisition device according to claim 1, wherein the matrix of elementary filters consists of an image projected by an optical projection system.

16. Image formation method, implemented in a device comprising a photocathode configured to convert an incident flux of photons into an flux of electrons, and a sensor, the image formation method including the following steps:

filter an initial flux of photons to supply said incident flux of photons, the filtering making use of a matrix of elementary filters including primary color filters (R, G, B; Ye, Ma, Cy), a primary color filter not transmitting a part of the visible spectrum complementary to said primary color, and filters transmitting the entire visible spectrum, named panchromatic filters;

calculate a quantity, termed a useful quantity, for determining whether at least one zone of the sensor is under conditions of weak or strong illumination, the useful quantity being representative of a mean surface flux of photons or electrons detected on a set of pixels named panchromatic pixels of the sensor, each panchromatic pixel being associated with a panchromatic filter; and form, only if said zone is under conditions of strong illumination, a color image of said zone on the basis of the pixels in this zone associated with the primary color filters (R, G, B; Ye, Ma, Cy).

* * * * *